US005397207A

United States Patent [19]

Arellano et al.

[11] Patent Number: 5,397,207

[45] Date of Patent: Mar. 14, 1995

[54] ADJUSTABLE CEILING PANEL INSTALLER

[76] Inventors: Daniel Arellano, P.O. Box 161, Gallina, N. Mex. 87017; George Spector, 233 Broadway Rm 702, New York, N.Y. 10279

[21] Appl. No.: 991,412

[22] Filed: Dec. 16, 1992

[51] Int. Cl.[6] ..... E04G 21/14

[52] U.S. Cl. ..... 414/11; 254/98

[58] Field of Search ..... 414/11, 10; 254/98, 254/7 R, 7 C; 187/9 R

[56] References Cited

U.S. PATENT DOCUMENTS

| | | | |
|---|---|---|---|
| 3,181,711 | 5/1965 | Stockton | 414/11 |
| 3,851,854 | 12/1974 | Roybal | 414/11 |
| 3,896,904 | 7/1975 | Walker | 187/9 R |
| 4,064,999 | 12/1977 | Young | 414/11 |
| 4,117,939 | 10/1978 | Haddock | 414/11 |
| 4,339,219 | 7/1982 | Lay | 414/11 |
| 4,375,934 | 3/1983 | Elliott | 414/11 |
| 5,026,245 | 6/1991 | Sabo | 187/9 R |

*Primary Examiner*—Michael S. Huppert
*Assistant Examiner*—Gregory A. Morse

[57] ABSTRACT

An adjustable ceiling panel installer is provided which consists of a base frame member, with a plurality of wheels mounted to the underside of the base frame member, so as to make the base frame member maneuverable. A pair of stanchion assemblies are provided, with each mounted at a lower end to one end of the base frame member in an upright position. A mechanism varies the height of the stanchion assemblies relative to the base frame member. A ceiling panel support frame member is mounted at each end to an upper end of the stanchion assemblies. The proper operation of the varying height mechanism will raise a ceiling panel against ceiling rafters and hold it thereto, so that the ceiling panel can be nailed to the ceiling rafters by at least one person.

3 Claims, 1 Drawing Sheet

ADJUSTABLE CEILING PANEL INSTALLER

BACKGROUND OF THE INVENTION

The instant invention relates generally to hoisting and positioning apparatuses and more specifically it relates to an adjustable ceiling panel installer, which provides a mechanism to lift a ceiling panel and hold it in place against rafters to be nailed thereto by one person.

There are available various conventional hoisting and positioning devices which do not provide the novel improvements of the invention herein disclosed.

SUMMARY OF THE INVENTION

A primary object of the present invention is to provide an adjustable ceiling panel installer that will overcome the shortcomings of the prior art devices.

Another object is to provide an adjustable ceiling panel installer that contains a lifting mechanism to place a ceiling panel against rafters and hold it thereto, so that it can be nailed by at least one person to the rafters.

An additional object is to provide an adjustable ceiling panel installer that is mounted on wheels, so that it can be maneuvered to better position the ceiling panel to the rafters.

A further object is to provide an adjustable ceiling panel installer that is simple and easy to use.

A still further object is to provide an adjustable ceiling panel installer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
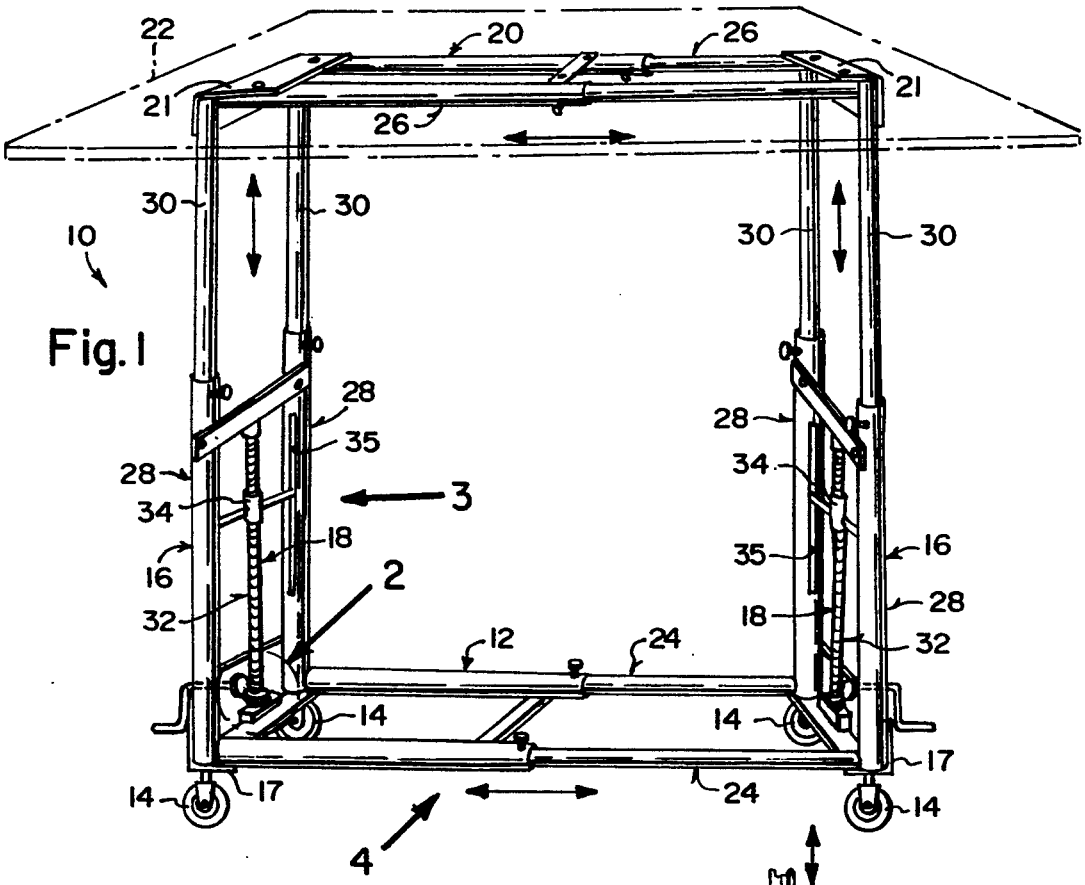
FIG. 1 is a perspective view of the instant invention.
Figure 2:
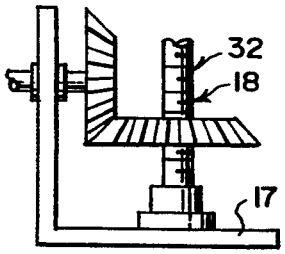
FIG. 2 is an enlarged view as indicated by arrow 2 in FIG. 1 showing one set of bevel gears in grater detail.
Figure 3:
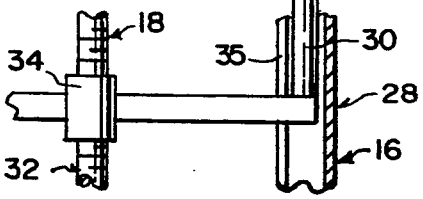
FIG. 3 is a partial elevational view with parts broken away and in section taken in the direction of arrow 3 in FIG. 1, showing the lift member in grater detail.

Turning now descriptively to the drawings, in which similar reference characters denote similar elements throughout the several views, the Figures illustrate an adjustable ceiling panel installer 10 which consists of a base frame member 12 with a plurality of wheels 14 mounted to the underside of the base frame member 12, so as to make the base frame member 12 maneuverable. A pair of stanchion assemblies 16 are provided, with each mounted at a lower end to one end 17 of the base frame member 12 in an upright position. A mechanism 18 is for varying the height of the stanchion assemblies 16 relative to the base frame member 12. A ceiling panel support frame member 20 is mounted at each end 21 to an upper end of the stanchion assemblies 16. The proper operation of the varying height mechanism 18 will raise a ceiling panel 22 against ceiling rafters and hold it thereto, so that the ceiling panel 22 can be nailed to the ceiling rafters by at least one person.

The base frame member 12 has a pair of retained horizontal parallel telescopic pipes 24 each having a movable concentric insert. The ceiling panel support frame member 20 has a pair of retained horizontal parallel telescopic pipes 26, so that the length of the installer 10 can be varied to compensate for different sized ceiling panels 22.

Each stanchion assembly 16 includes a pair of retained vertical parallel pipes 28, each having a moveable concentric segment 30. The height varying mechanism 18 includes a pair of crank operable jacks 32, each having a lift member 34 coupled to the two moveable segments 30 of one pair of the retained vertical parallel pipes 28 through slots 33.

Figure 4:
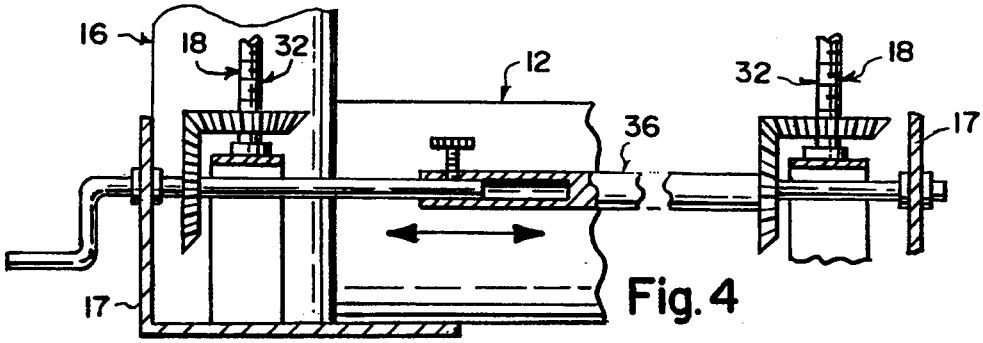
FIG. 4 is an elevational view of a modification taken in the direction of arrow 4 in FIG. 1 with parts broken away and in section, showing a structure in which one crank arm will operate the two sets of bevel gears at the same time.

As shown in the modification of FIG. 4, an adjustable coupling shaft 36 extends between the pair of crank operable jacks 32. The pair of crank operable jacks 32 can be manually operated simultaneously by a single crank on one side of the assembly to evenly raise and lower the ceiling panel support frame member 20.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An adjustable ceiling panel installer which comprises:

a) a base frame member with an underside and opposite ends;

b) a plurality of wheels mounted to said underside of said base frame member so that as to make said base frame member maneuverable;

c) a pair of spaced stanchions .with upper and lower ends each pair mounted at said lower ends on said opposite ends of said base frame member in an upright position; each stanchion includes a pair of spaced uprights;

d) means for varying the height of each said stanchion assemblies, mounted on each said stanchions comprising a vertically movable central lift bar mounted on a lift mechanism extending upward from said frame between said uprights and wherein said bar is coupled to movable inserts in each of said uprights, whereby vertical movement of said bar effects simultaneous vertical movement of said inserts;

e) a ceiling panel support frame mounted at each end on said inserts; whereby actuation of said means will vary the height of the ceiling support frame; further including:

f) said base frame member having a pair of retained horizontal parallel pipes, each with movable concentric inserts; and g) said ceiling panel support frame member having a pair of retained horizontal parallel pipes, each with movable concentric inserts, so that the length of said installer can be varied to compensate for different sized ceiling panels; wherein said height varying means includes a pair of crank operable threaded jacks, each threaded to said lift bar, wherein said uprights have a vertical slot to receive said bar.

2. An adjustable ceiling panel installer, as recited in claim 1, further including a length adjustable shaft, coupling said crank operable jacks, whereby actuation of one of said crank operable jacks will simultaneously raise or lower said stanchions and said ceiling panel support frame.

3. An adjustable ceiling panel installer, as recited in claim 2, wherein each said jack is mounted on a support an equal distance above said shaft.

* * * * *